United States Patent [19]

Hartley

[11] 4,067,290

[45] Jan. 10, 1978

[54] PURSE THEFT ALARM

[76] Inventor: Allen W. Hartley, 74 Erdman Ave., Princeton, N.J. 08540

[21] Appl. No.: 767,240

[22] Filed: Feb. 10, 1977

[51] Int. Cl.[2] ..... A45C 13/20; G08B 13/14

[52] U.S. Cl. ..... 116/99; 116/DIG. 44; 150/47

[58] Field of Search ..... 116/99, DIG. 44, 77, 116/75, 81; 42/1 G; 222/153; 150/47

[56] References Cited

U.S. PATENT DOCUMENTS

| | | | |
|---|---|---|---|
| 1,505,954 | 8/1924 | Gill | 116/99 |
| 2,461,588 | 2/1949 | Cooper | 116/99 |
| 2,554,789 | 5/1951 | Merola | 116/DIG. 44 |
| 2,626,585 | 1/1953 | Mendes | 116/DIG. 44 |
| 2,708,895 | 5/1955 | Ward | 116/DIG. 44 |

FOREIGN PATENT DOCUMENTS

| | | | |
|---|---|---|---|
| 382,265 | 10/1932 | United Kingdom | 116/77 |

*Primary Examiner*—Daniel M. Yasich

*Attorney, Agent, or Firm*—Behr & Woodbridge

[57] ABSTRACT

A theft alarm device adapted to be utilized between a lady's purse and the strap associated therewith, and constructed of a housing means including a whistle forming a part thereof, with an aerosol container having a valve at one end thereof and mounted within the housing means in alignment with the whistle such that when the container is opened the pressurized gas released therefrom will activate the whistle to produce an audible alarm sound therefrom. Coupling means is associated with each end of the housing means for securing same between the strap and the lady's purse, with activating means operatively associated with the coupling means and the container so as to obtain a release of the valve such that the gas activates the whistle to produce the audible sound when a predetermined force is applied to the lady's purse. Accordingly, a sudden pull or jerking force exerted on the purse or handle will cause the alarm to be actuated.

7 Claims, 2 Drawing Figures

PURSE THEFT ALARM

BACKGROUND OF THE INVENTION

The present invention relates to an alarm device which may be readily attached to a lady's purse for automatically producing an audible alarm in response to a sudden pull or jerking force exerted on the purse handle or carrying strap, such as would occur if a thief attempted to snatch the purse from its owner.

OBJECTS OF THE INVENTION

An object of the present invention is to provide a purse theft alarm which is automatically activated when a jerking force or sudden pull is applied against the purse.

Another object of the present invention is to provide an alarm unit which, once activated, will continue to operate until a part of the unit is dismantaled, so that if a thief succeeds in snatching the purse from its owner the audible alarm will continue to function to guide police or other pursuers following the thief.

Another object of the present invention is to provide a purse theft alarm that can easily be manufactured and that includes an aerosol container that is replaceable for activating same.

Other objects and advantages of the present invention will be apparent as the disclosure proceeds.

SUMMARY OF THE INVENTION

A theft alarm device adapted to be utilized between a lady's purse and the strap associated therewith, and constructed of a housing means including a whistle forming a part thereof, with an aerosol container having a valve at one end thereof and mounted within the housing means in alignment with the whistle such that when the container is opened the pressurized gas released therefrom will activate the whistle to produce an audible alarm sound therefrom.

Coupling means is associated with each end of the housing means for securing same between the strap and the lady's purse, with activating means operatively associated with the coupling means and the container so as to obtain a release of the valve such that the gas activates the whistle to produce the audible sound when a predetermined force is applied to the lady's purse. Accordingly a sudden pull or jerking force exerted on the purse or handle will cause the alarm to be actuated.

BRIEF DESCRIPTION OF THE DRAWINGS

Although the characteristic features of this invention will be particularly pointed out in the claims, the invention itself, and the manner in which it may be made and used, may be better understood by referring to the following description taken in connection with the accompanying drawings forming a part hereof, wherein like reference numerals refer to like parts throughout the several views and in which:

DETAILED DESCRIPTION OF THE DRAWINGS

Figure 1:
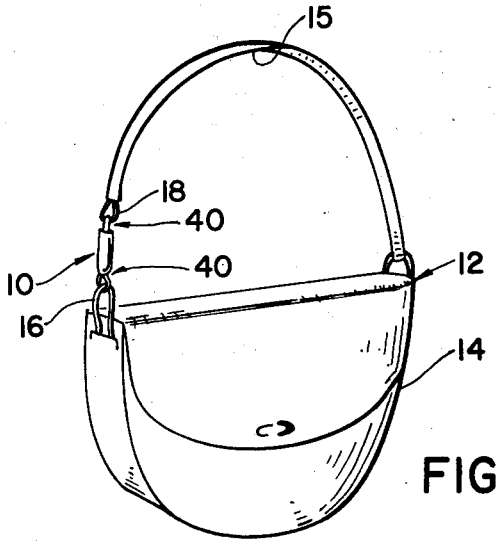
FIG. 1 is a perspective view of a lady's purse equiped with the alarm.

Referring to the drawings, the theft alarm 10 is to be utilized with a lady's purse 12 having a body 14 and strap 15. The body 14 may have a connecting element

16 and the strap 15 may likewise have an attachment member 18 associated therewith. The theft alarm device 10 is mounted therebetween and designed to release an audible alarm in response to a sudden pull or jerking force exerted on the purse handle or strap 15 or the purse body 14.

The device 10 includes housing means 20 having a whistle 21 associated therewith at one end thereof. The housing means 20 includes an elongated body element 22 having spaced apart ends 24 and 25 with an outer surface 26 that may be circular or have some other configuration. The body element 22 includes an axial bore 28 extending inwardly from the lower end 25 for receiving therein an aerosol container 30. The body element 22 further includes a seat 32 in substantial axial alignment with the bore 28.

The container 30 includes a tubular canister 34 mounted in telescopic relationship in the bore 28 and having a valve 35 at one end thereof with a valve stem 36 extending outwardly therefrom. The container 30 is mounted in alignment with the whistle 21 such that when the valve 35 is open the pressurized gas is released therefrom to activate the whistle 21.

To mount the device 10 coupling means 40 is provided at each end of the housing means 20 and extends outwardly therefrom. At the end 25 of the body element 22 a removable cap or cover 42 is provided having a ring 44 at one end thereof to receive the connecting element 16. The cap may be threadably secured in order to permit the container 30 to be removed from the axial bore 28 and replaced from time to time. The coupling means 40 at the opposite end 24 of the housing means 20 includes a ring 45 adapted to be secured to the attachment member 18 associated with the strap 15. It is appreciated that the mounting of the device 10 may be reversed and still remain operational in accordance with the present invention.

Figure 2:
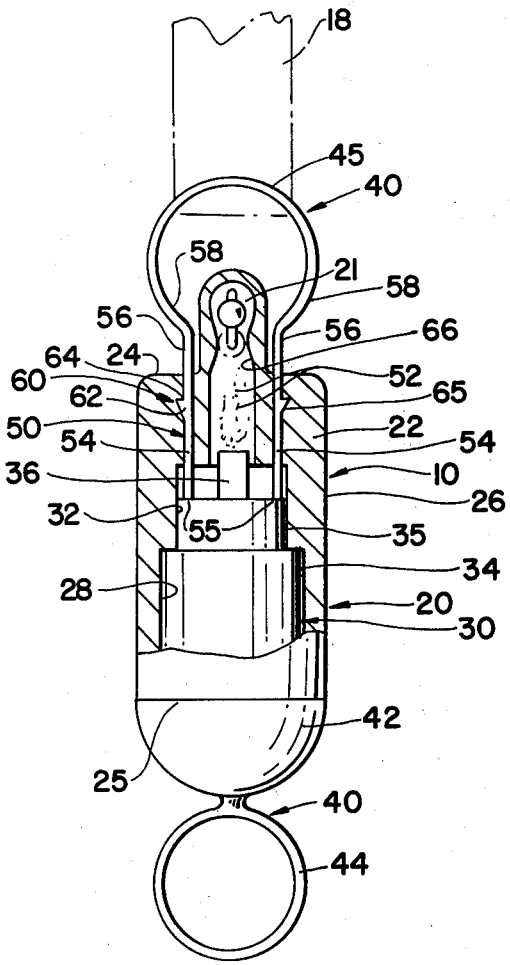
FIG. 2 is a sectional view taken along a vertical plane illustrating the invention.

Activating means 50 is operatively associated with the coupling means 40 and the container 30 so as to obtain a release of the valve 35 such that the gas 52 activates the whistle 21 to produce the audible sound when a predetermined force is applied to the lady's purse 12 as discussed above. The activating means 50 includes a pair of restraining members 54 extending through the body element 22 and having one end 55 for engaging the valve 35 to retain it in the closed position thereof. The other end 56 of each restraining member 54 is connected to the coupling means 40 at the ring 45 at the lower end 58 thereof. In this manner an axial force applied to the coupling means 40 will in effect tend to pull the ring 45 out from the position illustrated in FIG. 2. To prevent this movement under normal conditions shear means 60 is associated with each restraining member 54 and interposed between the respective ends 55 and 56.

The shear means 60 may include a protrusion 62 embedded within the body element 22 to provide a locking engagement to prevent the axial movement of the restraining members 54 relative to the housing means 20. Each protrustion includes a rear end 64 and an inclined front end or wall 65 relative thereto. The size of the protrusion, which may be integrally formed with the restraining members 54, are designed to be sheared off when a precalculated force is applied.

The whistle 21 extends outwardly from the end 24 of the housing means 20 and includes a cavity 66 in the body element 22 in axial alingment with the seat 32. In this manner when the protrusions 62 are sheared off and the ring 45 moves outwardly from the housing means 20 the valve 35 is opened with the resultant release of gas 52 thereby sounding the audible alarm in a manner to scare off any intended purse snatcher. The body element 22 may be made from a plastic material and the complete unit may be disposable after a single use, or the container 30 replaced from time to time.

Although an illustrative embodiment of the invention has been described in detail herein with reference to the accompanying drawings, it is to be understood that the invention is not limited to the precise embodiment and that various changes and modifications may be effected therein without departing from the scope or spirit of the invention.

I claim:

1. A theft alarm device adapted to be utilized with a lady's purse having a strap assoicated therewith, said device comprising:

a whistle;

a housing means connected to said whistle;

a valve mounted within said housing means;

an aerosol container connected to an operatable by said valve;

coupling means connected to said device for securing same between said purse and said purse strap; and, activating means operatively assoicated with said coupling means and said container so as to obtain a release of said valve such that the aerosol gas activates said whistle to produce said audible sound when a predetermined force is applied to said lady's purse, said activating means including:

at least one restraining means for engaging said valve and restraining same in the normally closed position thereof, said restraining member being connected to one of said coupling means; and, shear means for releasing said restraining means in response to said predetermined force.

2. A theft alarm device adapted to be utilized with a lady's purse having a strap associated therewith, said device comprising:

a. housing means including a whistle forming a part thereof;

b. an aerosol container having a valve at one end thereof and mounted within said housing means in alignment with said whistle such that when said valve is opened, pressurized gas released from said container will activate said whistle to produce an audible sound therefrom, said housing means further including an elongated body element having an axial bore at one end thereof for receiving said aerosol container, said body element including a valve seat in substantial axial alignment with said bore to receive said valve therein, said valve being movable between a normally closed position to an open position to allow gas to be released therethrough;

c. coupling means associated with each end of said housing means for securing same between said strap and said lady's purse; and, d. activating means operatively connected with said coupling means and said container so as to obtain a release of said valve such that the gas activates said whistle to produce said audible sound when a predetermined force is applied to said lady's purse, said activating means including:

at least one restraining member extending through said body element and having one end thereof engaging said valve to retain same in the closed position thereof;

said other end of said restraining member connected to said coupling means at one end of said housing means; and, shear means interposed between the respective ends of said restraining member and including a protrusion embedded in said body element to provide a locking engagement to prevent axial movement of said restraining member relative to said body element.

3. A device as in claim 2, wherein said protrusion includes a rear end and an inclined front end relative thereto.

4. A device as in claim 2, wherein a pair of said restraining members are provided, each having said protrusion thereon, and said restraining members being in spaced apart relationship to each other.

5. A device as in claim 2, wherein said restraining members are integrally formed with said coupling means at one end thereof to form a ring adapted to be secured to the lady's purse or the strap.

6. A device as in claim 2, wherein said whistle extends outwardly from one end of said housing means and includes a cavity in said body element in axial alignment with said seat for receiving the flow of gas therethrough to produce an audible alarm.

7. A device as in claim 2, wherein said container in said body element is replaceable.

* * * * *